US008106737B2

(12) United States Patent
Sugiyama et al.

(10) Patent No.: US 8,106,737 B2
(45) Date of Patent: Jan. 31, 2012

(54) TERMINAL STRUCTURE OF COIL DEVICE

(75) Inventors: Koichi Sugiyama, Nagoya (JP); Osamu Mizuno, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/751,228

(22) Filed: Mar. 31, 2010

(65) Prior Publication Data

US 2010/0245010 A1 Sep. 30, 2010

(30) Foreign Application Priority Data

Mar. 31, 2009 (JP) ..... 2009-084313

(51) Int. Cl.
*H01F 27/29* (2006.01)
*H01F 27/30* (2006.01)
*H01F 27/28* (2006.01)

(52) U.S. Cl. ..... 336/192; 336/198; 336/223

(58) Field of Classification Search ..... 336/192, 336/198, 223
See application file for complete search history.

(56) References Cited

U.S. PATENT DOCUMENTS

| | | | | |
|---|---|---|---|---|
| 7,196,606 | B2 | 3/2007 | Sawazaki et al. | |
| 2006/0255898 | A1* | 11/2006 | Sawazaki et al. | 336/90 |
| 2008/0237519 | A1* | 10/2008 | Sugiyama | 251/129.15 |

FOREIGN PATENT DOCUMENTS

| | | |
|---|---|---|
| EP | 1 043 735 | 10/2000 |
| JP | 2000-311813 | 11/2000 |
| JP | 2001-76927 | 3/2001 |
| JP | 2002-57025 | 2/2002 |
| JP | 2002-299118 | 10/2002 |
| JP | 2008-270242 | 11/2008 |

OTHER PUBLICATIONS

English Translation of JP 2002-299118, Natsume et al., Solenoidd Device, Oct. 11, 2002.*
Japanese Office Action dated Dec. 28, 2010, issued in corresponding Japanese Application No. 2009-084313 with English Translation.

* cited by examiner

*Primary Examiner* — Anh Mai
*Assistant Examiner* — Tsz Chan
(74) *Attorney, Agent, or Firm* — Nixon & Vanderhye PC

(57) ABSTRACT

A terminal structure of a coil device includes a coil having a rectangular conductive wire covered with a dielectric film, and a terminal having a fusing part. An end portion of the wire from the coil has first and second flat surfaces, and the fusing part is electrically connected to these flat surfaces by fusing. The fusing part includes a planar portion surface-contacting a first flat surface, and a folded piece folded in a direction perpendicular to a plane of the planar portion. The end portion is clamped between the planar portion and the folded piece. The folded piece includes a contact surface portion contacting a second flat surface. The contact surface portion includes a stepped portion that increases a deformation amount of a contact area of the second flat surface contacting the stepped portion, compared to an adjacent area of the second flat surface adjacent to the contact area.

7 Claims, 5 Drawing Sheets

TERMINAL STRUCTURE OF COIL DEVICE

CROSS REFERENCE TO RELATED APPLICATION

This application is based on and incorporates herein by reference Japanese Patent Application No. 2009-84313 filed on Mar. 31, 2009.

BACKGROUND OF THE INVENTION

1. Field of the Invention

The present invention relates to a terminal structure of a coil device, and is suitably applied, for example, to a terminal structure of a coil device in which a rectangular conductive wire having a flattened sectional shape is wound.

2. Description of Related Art

Conventionally, for example, a coil device which is incorporated into a driving unit that drives a valve body of an injector, is known (see, for example, JP-A-2008-270242). This type of coil device includes a coil formed as a result of winding a conductive wire around a bobbin, and a terminal to which an end of the conductive wire taken out from the coil is connected. This terminal includes a terminal structure having a folded piece that temporarily calks the end of the conductive wire before the end of the wire is coupled electrically to the terminal by fusing.

In recent years, improvement in winding efficiency is required for downsizing or improvement in magnetic properties of the coil device.

According to the device described in the publication of JP-A-2008-270242 as a type of such a terminal structure of the coil device, a shape of the folded piece for joining by fusing the above-described end of the wire of the coil that uses a rectangular conductive wire after temporarily calking this end, is proposed. By virtue of this technology, because a rectangular conductive wire having a rectangular shape in cross section is used for the coil, the space factor of the wire in a coil accommodating space of the bobbin becomes high, and eventually the winding efficiency is improved.

The folded piece is bent over to be folded back from a first planar portion of a terminal body, and includes a second planar portion such that the above end of the wire is placed between the first planar portion and the second planar portion.

However, in the above conventional technology of JP-A-2008-270242, because of the use of the rectangular conductive wire having a more flattened shape in cross section than a round conductive wire, it is difficult to bring the first and second planar portions in to contact evenly with both flat surfaces of the rectangular conductive wire by deforming the second planar portion of the folded piece through the calking. In other words, the conductive wire may be insufficiently calked depending on an insertion position of the end of the rectangular conductive wire, which is inserted between the first and second planar portions. There is concern that the conductive wire may fall out or the rectangular conductive wire may move at the time of the fusing joint to make a joining state unstable as a result of the insufficient calking of the wire. The excessively unstable joining state decreases the reliance on conductivity.

SUMMARY OF THE INVENTION

The present invention addresses at least one of the above disadvantages.

According to the present invention, there is provided a terminal structure of a coil device including a coil and a terminal. The coil includes a bobbin and a rectangular conductive wire having a flattened quadrangular shape in cross section. The wire is covered with a dielectric film and wound around the bobbin. The terminal includes a fusing part. An end portion of the wire, which extends out of the coil, has first and second flat surfaces that are opposed to each other, and the fusing part is electrically connected to the first and second flat surfaces by fusing. The fusing part includes a planar portion and a folded piece. The planar portion has a shape of a plate and is in surface contact with a first flat surface of the first and second flat surfaces. The folded piece extends from the planar portion and is folded in a direction perpendicular to a plane of the planar portion such that the end portion of the wire is clamped between the planar portion and the folded piece. The folded piece includes a contact surface portion which is in contact with a second flat surface. The contact surface portion includes a stepped portion that is configured to increase an amount of deformation of a contact area of the second flat surface which is in contact with the stepped portion, in comparison to an adjacent area of the second flat surface that is adjacent to the contact area.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the invention will be described below with reference to the accompanying drawings. By using the same numerals to indicate corresponding components in the embodiments, repeated explanations are omitted.

First Embodiment

Figure 1:
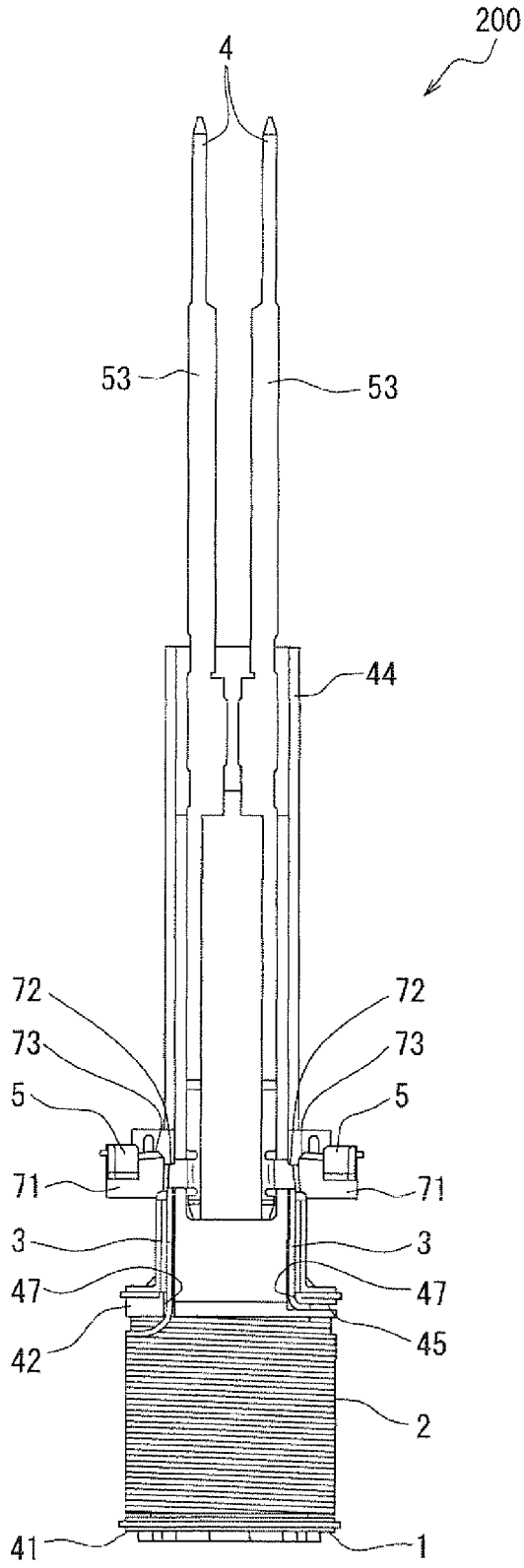
FIG. 1 is an appearance diagram illustrating a terminal structure of a coil device in accordance with a first embodiment of the invention.
Figure 2A:
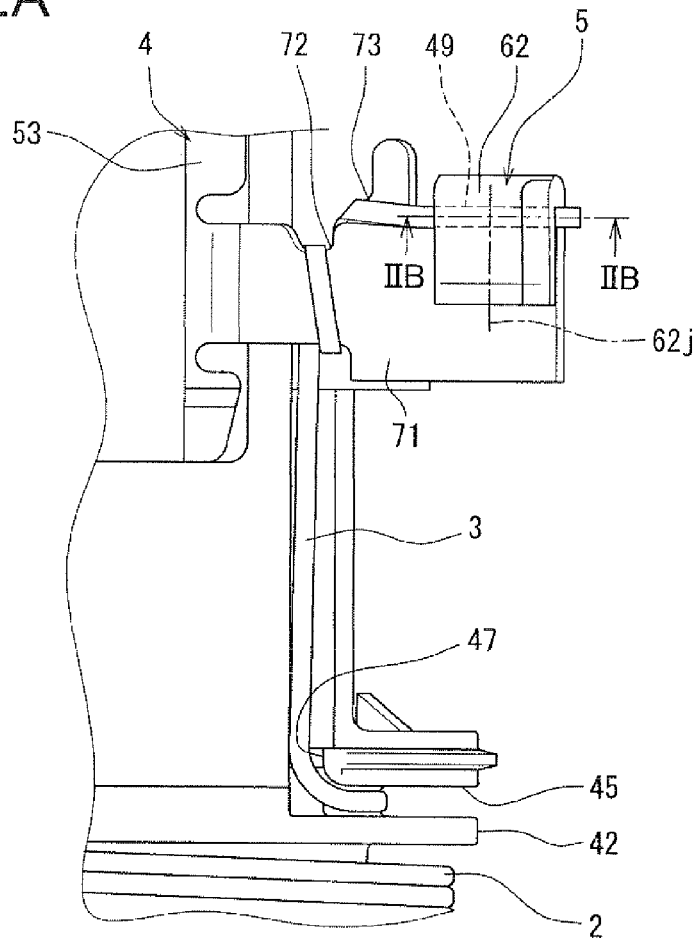
FIG. 2A is an enlarged appearance diagram illustrating a fusing portion of a terminal in FIG. 1.
Figure 2B:
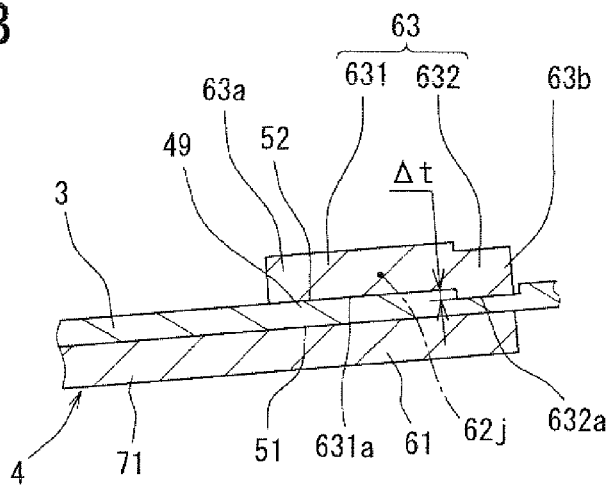
FIG. 2B is an enlarged sectional view taken along a line IIB-IIB in FIG. 2A.
Figure 3A:
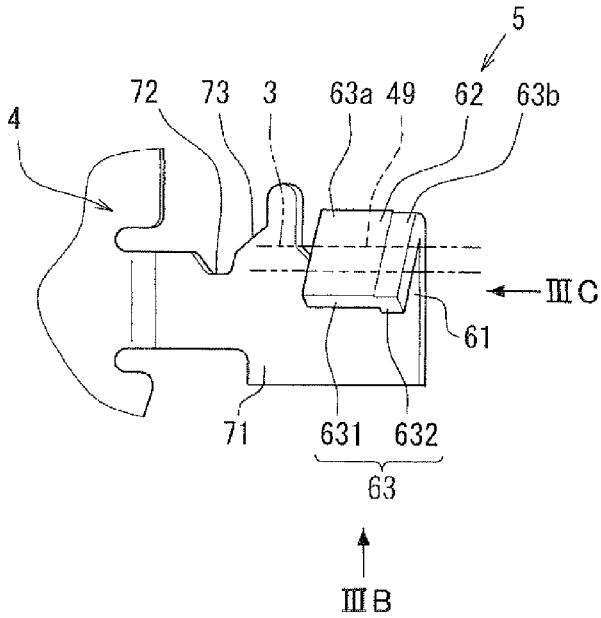
FIG. 3A is an appearance diagram illustrating a characteristic shape of the terminal in FIGS. 2A and 2B.
Figure 3C:
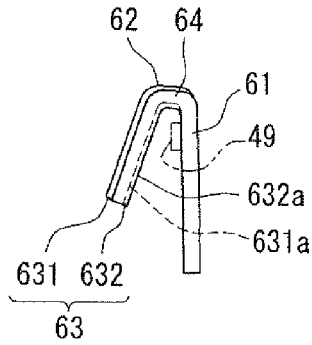
FIG. 3C is an arrow view which is viewed from a direction of an arrow IIIC in FIG. 3A.
Figure 3B:
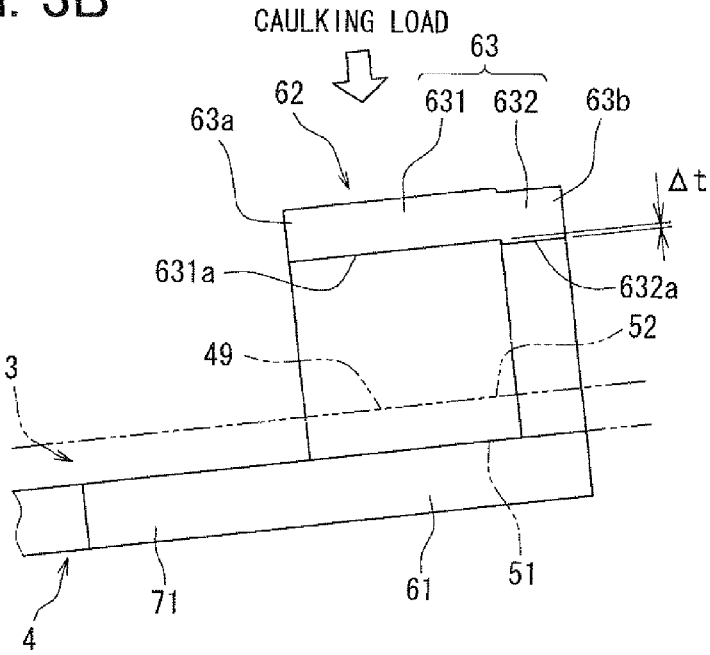
FIG. 3B is an arrow view which is viewed from a direction of an arrow IIIB in FIG. 3A.
Figure 4:
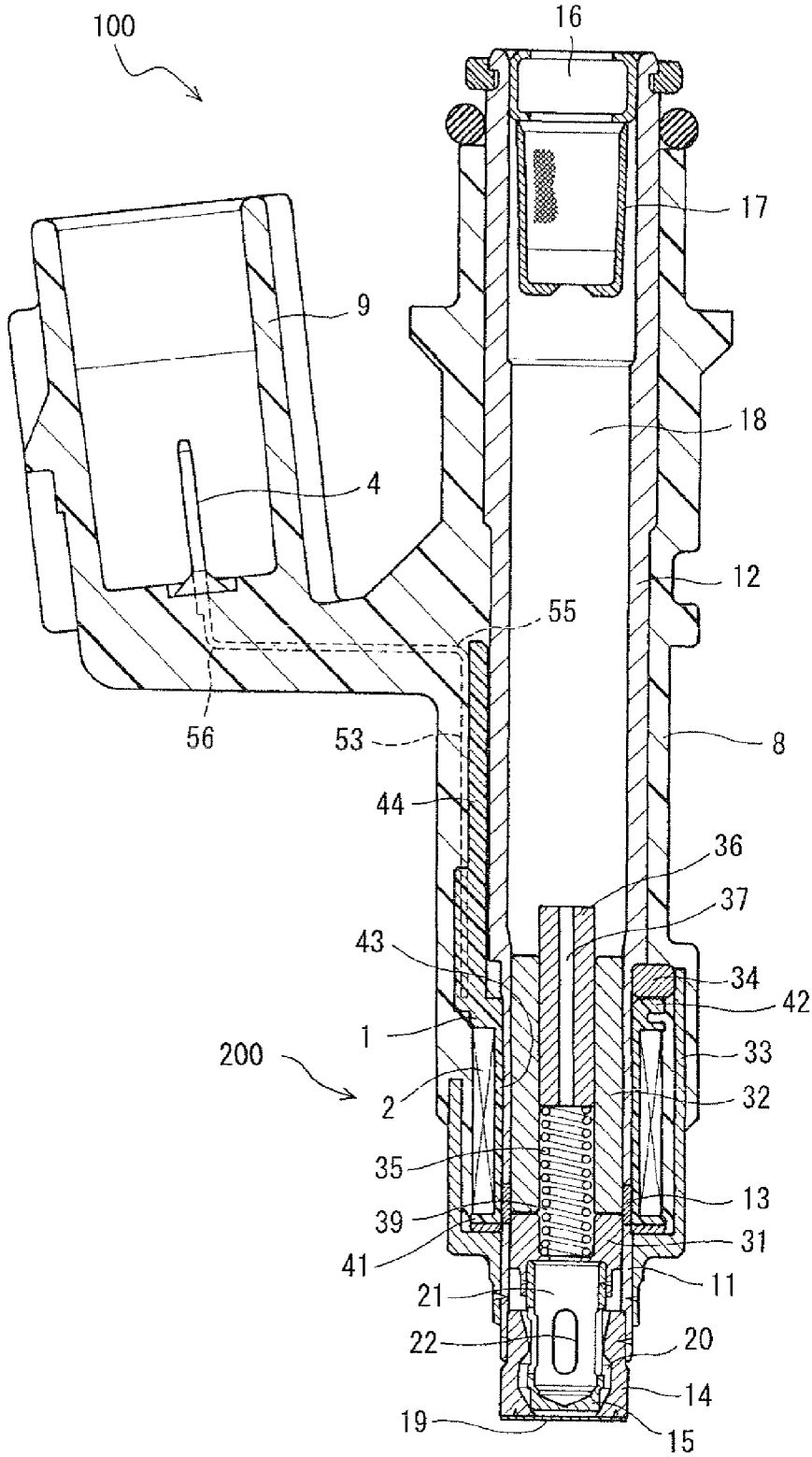
FIG. 4 is a longitudinal sectional view illustrating an example of an injector to which the coil device in accordance with the first embodiment is applied.

FIGS. 1 to 4 illustrate a terminal structure of a coil device 200 in accordance with a first embodiment of the invention. FIG. 1 illustrates an example of the coil device 200, and FIGS. 2A to 3C illustrate a characterizing portion of the terminal structure. FIGS. 2A and 2B illustrate a fusing portion, which is a main feature of the terminal structure, and FIGS. 3A to 3C illustrate the terminal structure before temporary calking. FIG. 4 illustrates an example of an injector 100 to which the coil device 200 of the present embodiment is applied.

The injector 100, to which the coil device 200 of the present embodiment is applied, is used for a direct gasoline-injection engine, for example. The injector 100 may be applied not only to the direct gasoline-injection engine but also to a premixed gasoline engine.

When the injector 100 is applied to the direct gasoline-injection engine, the injector 100 is disposed on a cylinder head of the engine such that a front end part of the injector 100 is disposed to exposed to a combustion chamber of the engine. The injector 100 is a fuel injection device that injects fuel directly into the combustion chamber of the engine. Fuel, which is pumped up from a fuel tank by a fuel supply pump such as a fuel pump and pressurized, is supplied to the injector 100. The injector 100 injects fuel, which is pressurized at a pressure equivalent to a fuel injection pressure through the fuel supply pump, into the combustion chamber.

As illustrated in FIG. 4, the injector 100 includes a drive unit that drives a needle 15 as a movable body, and this drive unit is constituted of the coil device 200, and includes a terminal structure of the coil device 200.

As illustrated in FIG. 1, the terminal structure of the coil device 200 is provided with components including a rectangular coil (hereinafter referred to simply as a coil) 2, a pair of coil terminals 4, and a mold resin 8. The coil 2 is formed as a result of winding multiple-times a rectangular conductive wire having a quadrangular cross-sectional surface (square cross section or rectangular cross section) around a bobbin 1. The rectangular conductive wire is formed as a result of covering a peripheral surface of a conductive core wire having a quadrangular cross-sectional surface formed from copper or a copper alloy with a dielectric film having a quadrangular tubular cross-sectional surface. The pair of coil terminals 4 is connected by fusing to a pair of coil lead wires 3 picked out from the coil 2. The mold resin 8 covers and protect connection portions between ends of the pair of coil lead wires 3 and fusing parts 5 of the pair of coil terminals 4.

The pair of coil lead wires 3 includes a coil lead wire 3 on a negative electrode side, and a coil lead wire 3 on a positive electrode side. The coil lead wire 3 on the negative electrode side is pulled out of, for example, an initial winding end segment of the coil 2, so as to be electrically connected by fusing to the fusing part 5 of the coil terminal 4 on a ground (GND) side (i.e., right-hand side in FIG. 1). The coil lead wire 3 on the positive electrode side is pulled out of a terminal winding end segment of the coil 2 so as to be electrically connected by fusing to the fusing part 5 of the coil terminal 4 on an external power source side or on an injector drive circuit side (i.e., left-hand side in FIG. 1). The pair of coil lead wires 3 is made of a rectangular conductive wire having a quadrangular cross-sectional surface and being covered with a dielectric film similar to the coil 2.

In addition, a structure of the coil device 200 which is applied to the injector 100 will be described in greater detail hereinafter.

As illustrated in FIG. 4, the injector 100 includes magnetic pipes 11, 12 and a nonmagnetic pipe 13, a valve body 14, the needle 15, and the drive unit including the above-described coil device 200 that drives the needle 15. The magnetic pipes 11, 12 and the nonmagnetic pipe 13 have cylindrical shapes and are supported and fixed by an inner peripheral surface of the mold resin 8. The valve body 14 is disposed radially inward of the magnetic pipe 12. The needle 15 is accommodated in the valve body 14 so as to reciprocate along an axis line of the valve body 14.

The valve body 14 is supported and fixed on an inner peripheral side of the magnetic pipe 11 by welding, for example. An opening of the magnetic pipe 12 that opens on its upper end side in FIG. 4 serves as a fuel feed port 16 through which fuel is fed into the injector. Fuel is supplied through the fuel feed port 16 by the fuel supply pump. Then, the fuel, which has been supplied to the fuel feed port 16, flows into a fuel passage 18 in the magnetic pipe 12 through a fuel filter 17. The fuel filter 17 is disposed radially inward of the magnetic pipe 12 close to the open end of the magnetic pipe 12 to remove foreign substances contained in fuel. The nonmagnetic pipe 13 prevents a magnetic short circuit between the magnetic pipe 11 and the magnetic pipe 12.

The valve body 14 is formed in a cylindrical shape, and has a valve seat on its conically-shaped inner wall surface having an inside diameter which becomes smaller toward an end of the inner wall surface. The valve body 14 has a nozzle hole plate 19 at its end portion on an opposite side of the magnetic pipe 12-side. The nozzle hole plate 19 is supported by and fixed to an end surface of the valve body 14 by welding or the like. Nozzle holes, which pass through an end surface of the nozzle hole plate 19 on the valve body 14-side, and an end surface of the plate 19 on the opposite side of the plate 19 from the valve body 14, are formed on the plate 19. These nozzle holes are for controlling a direction of sprayed fuel and for promoting atomization of the sprayed fuel.

The needle 15 is a valving element of the injector 100, and has a sealing portion, which engages with the valve seat of the valve body 14, at an end portion of the needle 15 on the nozzle hole plate 19-side. A fuel passage 20, through which fuel flows, is defined between an outer wall surface of the needle 15 and an inner wall surface of the valve body 14. In the injector 100 of the present embodiment, the fuel passage 20 and the nozzle holes communicate as a result of disengagement of the sealing portion of the needle 15 from the valve seat. The needle 15 is the valving element that closes and opens the fuel passage 20 leading fuel into the nozzle holes as a result of its engagement with and its disengagement from the valve seat of the valve body 14.

In the present embodiment, the needle 15 is cylindrically formed. The needle 15 includes a fuel passage 21 inside the needle 15. The needle 15 includes a fuel hole 22 that connects the fuel passage 21 and the fuel passage 20. The needle 15 is not limited to the cylindrical shape, and may also be formed in a solid cylindrical shape.

The drive unit includes an electromagnetic driving unit including the coil 2 and a movable core 31 that is magnetically attracted to the electromagnetic driving unit. The electromagnetic driving unit includes the coil device 200, a fixed core 32, a yoke 33, and a magnetic member 34, which is C-shaped in cross section. The fixed core 32, the yoke 33 and the magnetic member 34 of these components are magnetized when driving electric power is supplied to the coil 2, and thereby constitute a magnetic circuit that attracts the movable core 31.

The fixed core 32 is cylindrically formed from a magnetic material such as iron, and fixed on an inner peripheral side of the magnetic pipe 11 by press-fitting, for example. The yoke 33 is formed from a magnetic material, and covers an outer peripheral side of the coil 2.

The movable core 31 is arranged to be opposed to the fixed core 32 coaxially with the fixed core 32 so as to reciprocate in the axial direction radially inward of the magnetic pipe 11 and the nonmagnetic pipe 13. The movable core 31 is cylindrically formed from a magnetic material such as iron. An end portion of the movable core 31 on the opposite side of the movable core 31 from the fixed core 32 is connected to the needle 15 integrally with the needle 15 by welding, for example, so that the movable core 31 is operatively associated with the needle 15.

A spring 35 which may serve as an urging member, is provided for the movable core 31 at an end portion of the movable core 31 on the fixed core 32-side. The spring 35 has force (hereinafter referred to as urging force) in a direction in which the spring 35 extends in the axial direction, and is disposed, such that both end portions of the spring 35 are located between the movable core 31 and an adjusting pipe 36. The spring 35 presses the movable core 31 and the needle 15 in a direction in which the movable core 31 and the needle 15 engage with the valve seat of the valve body 14. The above adjusting pipe 36 is fixed in the fixed core 32 by press-fitting, for example, and the urging force (load) of the spring 35 is adjusted by adjusting the press-fit amount of the adjusting pipe 36 by which the adjusting pipe 36 is press-fitted into the fixed core 32. An axial hole 37, through which the fuel passage 18 and the fuel passage 21 communicate, is formed in the adjusting pipe 36.

The fixed core 32 is arranged to be opposed to the movable core 31 with a predetermined clearance maintained between the fixed core 32 and the movable core 31. This clearance defined between the movable core 31 and the fixed core 32 corresponds to the lift amount of the needle 15. A spring accommodating chamber 39 for accommodating the spring 35 is formed in the fixed core 32.

The basic structure of the injector 100, which mainly includes the coil device 200, has been described above. A basic structure of the coil device 200 will be described below.

The coil device 200 includes the bobbin 1, the coil 2, the coil terminal 4, and the mold resin 8.

The bobbin 1 is integrally formed from a resin material. The bobbin 1 is a resin part (primary molded product) including a pair of flanged portions 41, 42 and a cylindrical portion 43 in order that a rectangular conductive wire with a dielectric film is wound multiple-times between the flanged portions 41, 42 and around the cylindrical portion 43, as illustrated in FIGS. 1 and 4. A terminal guide 44, which is arc-shaped in cross section and guides the pair of coil terminals 4, extends upward from the flanged portion 42 on one side of the bobbin 1 in FIGS. 1 and 4.

An engaging groove 45 and two engaging grooves 47 are formed on the flanged portion 42. The engaging groove 45 is for engaging with a coil 2 side-end portion of the coil lead wire 3 on the negative electrode side that is pulled out of the initial winding end segment of the coil 2. The two engaging grooves 47 are for engaging with intermediate parts of the pair of coil lead wires 3 pulled out of the initial winding end segment and the terminal winding end segment of the coil 2. The engaging grooves 47 are for directing easily ends of the pair of coil lead wires 3 straight toward each lead wire bundle portion 72 of the pair of coil terminals 4.

The coil 2 is formed as a result of winding multiple-times a rectangular conductive wire covered with a dielectric film between the pair of flanged portions 41, 42 and on the outer peripheral surface of the cylindrical portion 43 The initial winding end segment of the rectangular conductive wire of the coil 2 is wound around the flanged portion 42 of the bobbin 1, and then the rectangular conductive wire is wound on the outer peripheral surface of the cylindrical portion 43 of the bobbin 1 by one layer. After that, the rectangular conductive wire is wound turning back to the flanged portion 42, and thereby a two-layer winding wire is formed. Alternatively, by repeating the above-described process, a four-layer winding wire may be formed around the cylindrical portion 43 of the bobbin 1.

The coil 2 is an exciting coil which generates magnetic attraction force (magnetomotive force) when driving power is supplied to the coil 2, and when the coil 2 is energized, it generates a magnetic flux around. Accordingly, because the movable core 31, the fixed core 32, the yoke 33 and the magnetic member 34, for example, are magnetized, the movable core 31 is attracted to the fixed core 32 to be lifted up (displaced). The coil 2 is configured to be energization-controlled by a control device (not shown).

The flanged portions 41, 42 and the cylindrical portion 43 of the bobbin 1 and coil 2 are disposed in a cylindrical space (coil accommodating space) formed between the magnetic pipe 12 and the nonmagnetic pipe 13, and the yoke 33. The coil 2 has a two-layer or four-layer winding portion wound around the bobbin 1, and the pair of coil lead wires 3 taken out from the initial winding end segment and terminal winding end segment of this winding portion.

An end (hereinafter referred to as a lead wire end) 49 of the coil lead wire 3 may correspond to an end portion of the rectangular conductive wire, and the coil terminal 4 may correspond to a terminal.

Each lead wire end 49 is electrically connected to a corresponding one of the fusing parts 5 of the pair of coil terminals 4 by a fusing joint. Each coil lead wire 3 includes first and second joint surfaces (first and second flat surfaces) 51, 52 having flat surface shapes on both sides of the lead wire end 49 in its thickness direction.

Each coil terminal 4 is formed in a predetermined shape by press punching a thin tabular metal plate. As illustrated in FIG. 1, each coil terminal 4 includes a thin tabular terminal body 53 and a thin tabular lead wire connection part 71. The terminal bodies 53 extend along the axial direction of the bobbin 1 and the coil 2 from a coil-side toward a connector shell-side, and the connection parts 71 extend to project respectively from these terminal bodies 53 in the right-left direction perpendicular to the axial direction of the bobbin 1 and the coil 2.

Each terminal body 53 of the pair of coil terminals 4 has two flections 55, 56 to make a level difference along the body 53 as illustrated in FIG. 4. A front end portion of each terminal body 53 on the opposite side of the terminal body 53 from the coil 2 is exposed to the inside of a connector shell (male connector) 9, which is formed in a shape of a rectangular cylinder integrally with the mold resin 8. The front end portions of the terminal bodies 53 functions as connector pins that are plugged into and thereby electrically connected with female connectors on the external power source side or on the injector drive circuit side and on the GND side.

Each lead wire connection part 71 of the pair of coil terminals 4 includes a corresponding one of the lead wire bundle portions 72 for bundling the intermediate parts of the coil lead wires 3 by winding a predetermined arbitrary number of times the intermediate parts of the coil lead wires 3 that are pulled out of the bobbin 1 and the coil 2 around the lead wire bundle portions 72.

The fusing part 5 which is U-shaped in cross section, and a conductive wire turning portion 73 are formed at each lead wire connection part 71 integrally with the lead wire connection part 71. In order to easily direct (lead) the lead wire end 49 of each coil lead wire 3, which is hooked on the lead wire bundle portion 72, straight toward the fusing part 5, the lead wire end 49 is wound around the turning portion 73 so that a direction, in which the lead wire end 49 is pulled out, is changed.

The mold resin 8 is formed integrally from a resin material having electrical insulation properties. The mold resin 8 covers and protects the bobbin 1, the coil 2, the coil lead wire 3, and the coil terminal 4 of the components of the coil device 200. A connector shell 9 is formed integrally with the mold resin 8. Accordingly, in the injector 100 of the present embodiment, the bobbin 1, the coil 2, the pair of coil lead wires 3, the pair of coil terminals 4, for example, are molded in the mold resin 8 having electrical insulation properties. Alternatively, a connection part between each lead wire end 49 of the pair of coil lead wires 3 and a corresponding one of the fusing parts 5 of the pair of coil terminals 4 may be molded in the mold resin 8.

The conductive wire turning portion 73 may correspond to a turning guide portion, and the lead wire bundle portion 72 may correspond to a conductive wire bundle portion.

The basic structure of the coil device 200 has been described above. A distinguishing structure of the coil device 200 will be described below.

As illustrated in FIGS. 2A to 3C, the fusing part 5 of the coil terminal 4 includes a tabular planar portion 61 that is in surface contact with the first joint surface 51 of the lead wire end 49 of the coil lead wire 3, and a folded piece 62 having a contact surface portion 63 that is opposed to the planar portion 61.

The folded piece 62 projects from an end portion of the planar portion 61 on its fold line side, and the folded piece 62 is bent over in a U-shaped manner from the end portion of the planar portion 61 on its fold line side, such that the lead wire end 49 of the coil lead wire 3 is placed (clamped) between the folded piece 62 and the planar portion 61. The folded piece 62 is bent over in a U-shaped manner in a thickness direction of the planar portion 61 such that the folded piece 62 is folded back from the end portion of the planar portion 61 on its fold line side. The folded piece 62 includes a bent portion 64 having a curvature radius, which is larger than a thickness of each lead wire end 49, and the bent portion 64 connects the planar portion 61 and the contact surface portion 63 such that the lead wire end 49 of the coil lead wire 3 is positioned between the planar portion 61 and the contact surface portion 63.

The contact surface portion 63 of the folded piece 62 is formed generally in a shape of a plate so that the portion 63 may be brought into surface contact with the second joint surface 52 of the lead wire end 49. As illustrated in FIGS. 2B and 3B, the contact surface portion 63 includes a stepped portion 632 that increases a crushing allowance (amount of deformation) of the lead wire end 49 in a longitudinal direction of the second joint surface 52.

In the present embodiment, the contact surface portion 63 includes a planar main part 631 and the stepped portion 632 that projects by a level difference $\Delta t$ from the main part 631 toward the second joint surface 52-side. Accordingly, the lead wire end 49, which is placed between the planar portion 61 and the contact surface portion 63, is in a crushed state having different ($t1<t2$) crushing allowances (crush amounts): a first crushing allowance (first crush amount) t1 that is generated as a result of the wire end 49 being placed between the planar portion 61 and the planar main part 631, and a second crushing allowance (second crush amount) t2 that is generated as a result of the wire end 49 being placed between the planar portion 61 and the stepped portion 632.

In the present embodiment, as illustrated in FIG. 3C, the planar main part 631 and the stepped portion 632 are formed respectively into flat surfaces 631*a*, 632*a*, which are brought into surface contact with the second joint surface 52 of the lead wire end 49.

The stepped portion 632 includes the flat surface 632*a* to come into surface contact with the second joint surface 52. The flat surface 632*a* of the stepped portion 632 is formed to extend along an orthogonal direction that is perpendicular to the longitudinal direction of the lead wire end 49, i.e., along a width direction of the lead wire end 49.

The stepped portion 632 may be formed so as to enhance a crushing effect on the lead wire end 49 at a portion of the contact surface portion 63 that corresponds to the stepped portion 632. Thus, for example, the stepped portion 632 may include a flat surface 632*a* which is in surface contact with the other flat surface 52 and which expands in a direction that is perpendicular to the longitudinal direction of the other flat surface 52. Accordingly, even if an insertion position for the lead wire end 49, which is inserted between the planar portion 61 and the contact surface portion 63, varies, a portion of the lead wire end 49 in its longitudinal direction is crushed by the flat surface 632*a* of the stepped portion 632 with a predetermined enhanced crushing allowance.

The stepped portion 632 is formed at an opposite end portion 63*b* of the contact surface portion 63, which is opposite from an end portion 63*a* on the coil 2 side (lead wire bundle portion 72-side). As a result, the crushing allowance for the lead wire end 49 is maximized (i.e., greatest crushing allowance t2) at the opposite end portion 63*b* of the contact surface portion 63.

The first joint surface 51 and the second joint surface 52 may correspond to both flat surfaces of the end portion of the rectangular conductive wire. The first joint surface 51 may correspond to one flat surface, and the second joint surface 52 may correspond to the other flat surface.

A distinguishing structure of the coil device 200 has been described above. A method for fusing-connection of the fusing part 5, which is the distinguishing structure, will be described below.

The pair of coil lead wires 3 taken out from the initial winding end segment and terminal winding end segment of the coil 2 is pulled out toward the respective lead wire bundle portions 72 of the pair of coil terminals 4 through the engaging groove 45 and the two engaging grooves 47 formed at the flanged portion 42 of the bobbin 1. Then, the pair of coil lead wires 3 pulled out toward the respective lead wire bundle portions 72 is hooked on the respective projecting conductive wire turning portions 73 of the pair of coil terminals 4 after their intermediate parts are bundled around the corresponding lead wire bundle portions 72 of the pair of coil terminals 4 by an arbitrary predetermined number of times.

Meanwhile, the pair of coil lead wires 3 hooked around the respective conductive wire turning portions 73 have directions of their lead wire ends 49 converted at the conductive wire turning portions 73 such that their lead wire ends 49 are pulled out straightly from the corresponding conductive wire turning portions 73 toward the fusing parts 5.

Each lead wire end 49 of the pair of coil lead wires 3 is inserted between the corresponding planar portion 61 and contact surface portion 63 of the corresponding folded piece 62. Meanwhile, as shown in FIGS. 3A to 3C each lead wire end 49 is pulled such that the whole plate width and length of its first joint surface 51 are in surface contact with the planar portion 61. In other words, predetermined tension is given to each lead wire end 49.

Then, the contact surface portion 63 of the folded piece 62 is calked by a punch (hereinafter referred to as a temporary calking process). As a result of the temporary calking illustrated in FIG. 2B, each lead wire end 49 of the pair of coil lead wires 3 is placed between the planar portion 61 and the contact surface portion 63 having the stepped portion 632, with the lead wire end 49 crushed therebetween to have the different crushing allowances t1, t2 in the above longitudinal direction (plate length direction) of the lead wire end 49 ($t1<t2$, and $t2-t1=\Delta t$). The first crushing allowance t1 corresponding to the planar main part 631 of the contact surface portion 63 can be set at a predetermined crushing allowance, and alternatively may be set at a slight crushing allowance or at generally no crushing allowance.

In the temporary calking process, through the deformation of the folded piece 62 by the calking, each lead wire end 49 of the pair of coil lead wires 3 is crushed between the planar portion 61 and the contact surface portion 63, and temporarily calked. At a region of the lead wire end 49 between the planar portion 61 and the contact surface portion 63, which corresponds to the stepped portion 632, the second crushing allowance t2 is made larger by the level difference Δt than a region except the stepped portion 632 in the longitudinal direction of the lead wire end 49.

Next, a pair of fusing electrodes is applied to the entire fusing part 5 from its both sides in a thickness direction of the fusing part 5 (from both sides of the planar portion 61 and the contact surface portion 63). As a result of energization of the fusing electrodes with the fusing part 5 pressurized, the dielectric film which covers each lead wire end 49 of the pair of coil lead wires 3 is exfoliated, so that a conduction state (electrical connection) at the connection part between each lead wire end 49 and the corresponding fusing part 5 of the pair of coil terminals 4 is achieved (hereinafter referred to as a fusing joint process).

As illustrated in FIG. 2B, between the planar portion 61 and the contact surface portion 63 having the stepped portion 632, a predetermined crushing allowance t0 due to the pressurization by the fusing electrodes is applied to the lead wire end 49 in the longitudinal direction of the lead wire end 49. As a consequence, each lead wire end 49 of the pair of coil lead wires 3 is placed between the planar portion 61 and the contact surface portion 63, with the lead wire end 49 crushed so as to have different crushing allowances (t1+t0) and (t2+t0).

Operation of the injector 100 having the above-described structure will be explained below with reference to FIGS. 1 and 4.

When the coil 2 in the drive unit of the injector 100 is energized, magnetomotive force is generated in the coil 2, and thereby the magnetic materials, such as the movable core 31, the fixed core 32, the yoke 33, and the magnetic member 34, are magnetized. Accordingly, magnetic attraction force is generated between the movable core 31 and the fixed core 32. Upon the magnetic attraction of the movable core 31 to the fixed core 32 because of the magnetomotive force of the coil 2, the movable core 31 is displaced to one side (to the upper side in FIG. 4) in its axial direction. In accordance with the displacement of the movable core 31 to the one side in the axial direction, the needle 15, which is cooperable with the movable core 31, also moves to the one side in the axial direction.

Thus, the sealing portion of the needle 15 disengages from the valve seat of the valve body 14 to open the plurality of nozzle holes formed on the nozzle hole plate 19. Accordingly, fuel which flows into the injector 100 through the fuel feed port 16 flows into the fuel passage 20 between the inner peripheral surface of the valve body 14 and the outer peripheral surface of the needle 15 via the fuel filter 17, the fuel passage 18 in the magnetic pipe 12, the axial hole 37 in the adjusting pipe 36, the fuel passage 21 in the needle 15, and the fuel hole 22 of the needle 15. Fuel which has flowed into the fuel passage 20 flows into the plurality of nozzle holes via between the needle 15, which has disengaged from the valve seat, and the valve body 14. As a result, fuel is injected through the nozzle holes.

When the energization of the coil 2 is stopped, the magnetic attraction force between the movable core 31 and the fixed core 32 no longer exists. In consequence, the needle 15 and the movable core 31 are pressed toward the valve seat of the valve body 14 by the urging force of the spring 35. Hence, the sealing portion of the needle 15 engages with the valve seat of the valve body 14, so that the nozzle holes are closed. Thus, the fuel injection is ended.

As described above, in the terminal structure of the coil device 200 in accordance with the present embodiment, the stepped portion 632 is provided for the contact surface portion 63 of each folded piece 62 of the pair of coil terminals 4, and each lead wire end 49 of the pair of coil lead wires 3 is placed between the corresponding stepped portion 632 and planar portion 61. By virtue of this structure, the crushing allowance is made larger than the other regions, at the region of the lead wire end 49 between the planar portion 61 and the contact surface portion 63 of the coil terminal 4, which corresponds to the stepped portion 632 in the longitudinal direction of the lead wire end 49. In this state, the placing of each lead wire end 49 of the pair of coil lead wires 3 between the planar portion 61 and the contact surface portion 63, and the crush of each lead wire end 49 therebetween, are fulfilled.

Consequently, at the time of the fusing connection, i.e., at the time of the temporarily calking and the fusing joint of the fusing part 5, by putting the lead wire end 49 between the planar portion 61 and the contact surface portion 63 and then calking the contact surface portion 63 of the folded piece 62 using a punch in the temporary calking process before the fusing joint process, the first and second joint surfaces 51, 52 of the lead wire end 49 can be crushed with the crushing allowance made larger at one portion of the lead wire end 49 corresponding to the stepped portion 632 than the other regions in the longitudinal direction (plate length direction). Therefore, the temporary calking properties are improved.

As a result, even if a crushing effect on each lead wire end 49 is insufficient at the above-described other regions of the lead wire end 49 in its longitudinal direction (plate length direction), the crushing effect of preventing the coil lead wire 3 from falling out of the fusing part 5 at the one portion in the longitudinal direction corresponding to the stepped portion 632, is produced. Accordingly, in the fusing joint process, separation of the lead wire end 49 of the coil lead wire 3 is prevented. Furthermore, after the temporary calking process, an insertion position for the lead wire end 49 is made stable in the fusing joint process. Because of this, the fusing joint is stably performed, and a joining state becomes stabilized.

Moreover, in the above temporary calking process, the region for increasing the crushing allowance is limited to the one portion in the longitudinal direction corresponding to the stepped portion 632. Hence, the entire crushing allowance of the first and second joint surfaces 51, 52 of each lead wire end 49 is not increased between the planar portion 61 and the contact surface portion 63, as in the conventional technology. For this reason, even though the lead wire end 49 is further heated and pressurized by the fusing joint after the temporary calking process, strength of each lead wire end 49 is not reduced over its entire first and second joint surfaces 51, 52. Thus, decrease of the reliability of the coil device 200 in conductivity of the coil lead wire 3, such as disconnection due to temperature change in an operating environment of the coil device 200, is limited.

Using the above-described terminal structure of the coil device 200 of the present embodiment, the lead wire end 49 of the coil lead wire 3 is prevented from falling out, and the decreased reliability in conductivity is limited.

In addition, in the above-described present embodiment, the stepped portion 632 of the contact surface portion 63 extends in the orthogonal direction perpendicular to the longitudinal direction of the second joint surface 52 of the lead wire end 49, in other words, the stepped portion 632 includes the flat surface 632*a* extending in the width direction of the lead wire end 49. Accordingly, the first and second joint surfaces 51, 52 of the lead wire end 49 of the coil lead wire 3 having a quadrangular shape that is flattened in cross section are brought into surface contact between the flat surface 632*a* of the stepped portion 632 and the planar portion 61. Thus, the first and second joint surfaces 51, 52 are crushed with the crushing allowance surfaces 51, 52 increased to a predetermined crushing allowance at the one portion of the lead wire end 49 that corresponds to the stepped portion 632, compared to the other regions of the lead wire end 49 in the longitudinal direction.

Additionally, a flat surface extending parallel to an axis 62*j*, which is a folding direction of the folded piece 62, as illustrated in FIG. 2A, may be substituted for the flat surface 632*a* of the stepped portion 632.

Accordingly, when the lead wire end 49 is inserted between the planar portion 61 and the contact surface portion 63, a longitudinal direction of the lead wire end 49 is at least inclined relative to the axis 62*j*, which is a folding direction of the folded piece 62, because the lead wire end 49 is arranged to pass between the planar portion 61 and the contact surface portion 63.

Even if an insertion position for the lead wire end 49, which is inserted between the planar portion 61 and the contact surface portion 63, varies, a portion of the lead wire end 49 in its longitudinal direction is crushed by the flat surface of the stepped portion 632 with a predetermined enhanced crushing allowance.

By deforming the folded piece 62 to temporarily calk the folded piece 62, the first and second joint surfaces 51, 52 of the lead wire end 49, which is inserted between the planar portion 61 and the contact surface portion 63, are pressed against the planar portion 61 and the contact surface portion 63. There is concern that stress is concentrated at a region of the first and second joint surfaces 51, 52 on which the stepped portion 632 for enhancing a crushing effect is pressed. If the stress concentration is excessively caused at the stepped portion 632, strength of the lead wire end 49 may be reduced at the stress-concentrated region.

In the above-described present embodiment, The stepped portion 632 is formed at an opposite end portion 63*b* of the contact surface portion 63, which is opposite from an end portion 63*a* on the coil 2-side (lead wire bundle portion 72-side). As a result, the crushing allowance for the lead wire end 49 is maximized (La, greatest crushing allowance t2) at the opposite end portion 63*b* of the contact surface portion 63.

Accordingly, even if the stress concentration should be excessively produced at the stepped portion 632, the strength of the coil lead wire 3 picked out from the coil 2 is not reduced at least at the end part of the lead wire end 49 on its side that is taken out of the coil 2. Thus, decrease of the reliability of the coil device 200 in conductivity because of the disconnection of the coil lead wire 3, is prevented.

In such an embodiment, the lead wire end 49 that is further on its extension side of the opposite end portion 63*b*, which is opposite from an end portion 63*a*, corresponds to a cut-off discardable side of the winding portion. For this reason, even if, by any chance, strength of the one portion of the lead wire end 49 that corresponds to the stepped portion 632 is reduced due to stress concentration, the strength of the coil lead wire 3 between the winding portion of the coil 2 and the lead wire end 49 of the coil lead wire 3 that is connected to the winding portion, is not reduced. Therefore, the decreased reliability in conductivity because of the disconnection of the coil lead wire 3 caused by its strength reduction is prevented.

Furthermore, the stress is concentrated on the first and second joint surfaces 51, 52 of the lead wire end 49 that is crushed by the flat surface 632*a* of the stepped portion 632, compared to an adjacent portion of the lead wire end 49 on which the fusing connection is not performed, i.e., the cut-off discardable side-portion of the lead wire end 49. Because of this, terminal treatment for cutting off the discardable side-portion is made easy, so that the terminal structure of the coil device 200 which is excelled in productivity, is accomplished.

More specifically, the strength reduction occurs at the opposite end portion 63*b*, which is opposite from the end part of the lead wire end 49 on its side that is taken out of the coil 2. Accordingly, the terminal treatment for cutting off an unnecessary end portion-of the lead wire end 49 that passes between the planar portion 61 and the contact surface portion 63 and that extends out of the opposite end portion 63*b* is facilitated.

Second Embodiment

Figure 5:
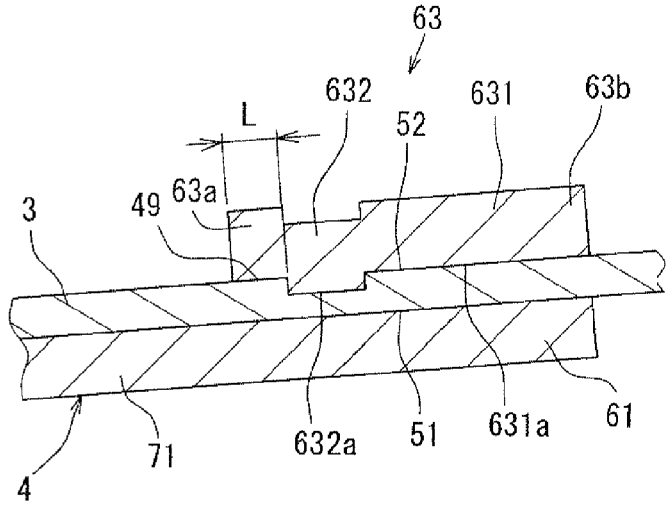
FIG. 5 is a sectional view illustrating a terminal structure of a coil device in accordance with a second embodiment of the invention and corresponding to FIG. 2B.

A second embodiment of the invention, which is a modification of the first embodiment, is shown in FIG. 5.

As illustrated in FIG. 5, a stepped portion 632 having a flat surface 632*a* is formed between an end portion 63*a* of a contact surface portion 63 on a coil 2-side (lead wire bundle portion 72-side), and an opposite end portion 63*b*, which is opposite from the coil 2-side end portion 63*a*. Accordingly, a portion of a lead wire end 49, on which a greater crushing effect by the stepped portion 632 is exerted, is located to be away by a distance L from an adjacent portion of a lead wire end 49, on which the fusing connection is not performed.

For this reason, conductive wire portions of an intermediate part of the coil lead wire 3 picked out from the coil 2 and the lead wire end 49, which are located on the coil 2-side and on which the fusing connection is not performed, are prevented from being located close to the stepped portion 632. Eventually, the development of excessive stress concentration near the stepped portion 632 is limited.

Figure 7:
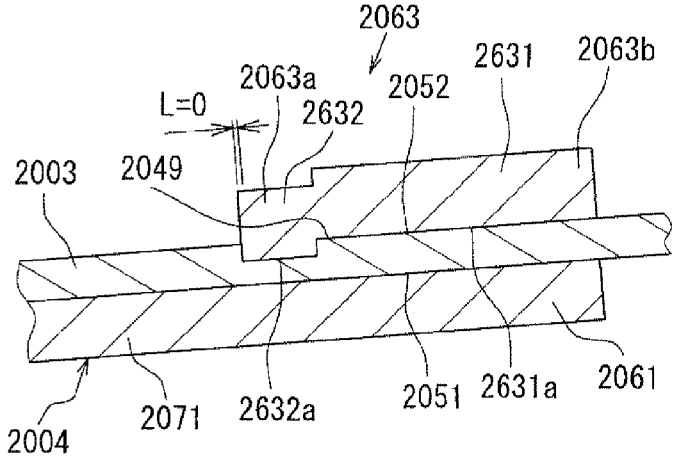
FIG. 7 RELATED ART
FIG. 7 is a sectional view illustrating a terminal structure of a coil device in accordance with a comparative example and corresponding to FIG. 2B.

In a comparative example illustrated in FIG. 7, a stepped portion 2632 is formed at a coil 2002-side end portion 2063*a* of a contact surface portion 2063, and thus, there is not the above distance L. For this reason, a portion of a lead wire end 2049 on which the fusing connection is not performed, i.e., the portion of the lead wire end 2049 located on a side of a winding portion of the coil 2002, is adjacent to one portion of the lead wire end 2049 that corresponds to the stepped portion 2632. Therefore, excessive stress concentration is caused near the one portion of the lead wire end 2049 that corresponds to the stepped portion 2632. In such a comparative example, decreased reliability in conductivity because of disconnection of a coil lead wire 2003 caused by its strength reduction, may be brought about.

On the other hand, in the present embodiment, although the stepped portion 632 is located on a side of the coil 2-side end portion 63*a*, the portion of a lead wire end 49, on which a greater crushing effect by the stepped portion 632 is exerted, is arranged so as to maintain the predetermined distance L from the adjacent portion of a lead wire end 49, on which the fusing connection is not performed. By such a distance L, development of the excessive stress concentration is limited near the one portion of the lead wire end 49 that corresponds to the stepped portion 632.

Accordingly, the decreased reliability in conductivity because of the disconnection of the coil lead wire 3 caused by its strength reduction is limited.

Third Embodiment

Figure 6:
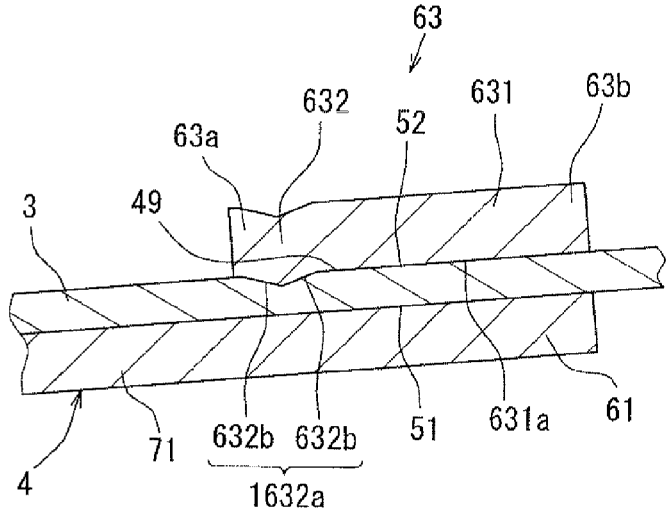
FIG. 6 is a sectional view illustrating a terminal structure of a coil device in accordance with a third embodiment of the invention and corresponding to FIG. 2B.

A third embodiment of the invention, which is a modification of the first embodiment, is shown in FIG. 6.

As illustrated in FIG. 6, a stepped portion 632 of a contact surface portion 63 includes a bending surface 1632*a* so that the surface 1632*a* may be brought into surface contact with a second joint surface 52 of a lead wire end 49. The bending surface 1632*a* is formed into such a shape that includes an inclined surface 632*b* which is V-shaped in cross section and that projects toward the second joint surface 52. The bending surface 1632*a* having the V-shaped inclined surface 632*b* extends in an orthogonal direction perpendicular to a longitudinal direction of the lead wire end 49, i.e., in the width direction of the lead wire end 49.

Accordingly, the stepped portion 632 of the present embodiment includes the bending surface 1632*a* whose sectional shape is the above-described shape projecting toward the second joint surface 52. Thus, a cross section of the stepped portion 632 has a shape that changes convexly toward the second joint surface 52 along the above longitudinal direction. In consequence, a sudden change of stress at one portion of the lead wire end 49 that corresponds to the stepped portion 632 is made avoidable. Therefore, development of the excessive stress concentration at the one portion of the lead wire end 49 that corresponds to the stepped portion 632 is prevented.

When the terminal structure having the turning portion 73 is applied to the terminal structure of the coil device 200, the lead wire end 49 is easily guided to establish a relationship between the longitudinal direction of the lead wire end 49 and the stepped portion 632 at the time the lead wire end 49 that is taken out of the coil 2 is inserted between the planar portion 61 and the contact surface portion 63, which constitute the fusing part 5.

The embodiments of the invention are described above. Nevertheless, the invention is not interpreted by limiting itself to these embodiments, and may be applied to various embodiments without departing from the scope of the invention. Modifications of the above embodiments will be described below.

Firstly, in the above-described present embodiments, the injector used for the direct gasoline-injection engine, which injects fuel directly into the combustion chamber, has been illustrated as the injector 100 in which the coil device 200 is disposed. Alternatively, an injector used for a gasoline engine which injects fuel into an intake port, or an injector used for a diesel engine, may be employed for the injector 100.

Secondly, the above-described present embodiments have been described using an example, in which the coil device 200 is applied to the drive unit that drives the needle 15 of the injector 100. The drive unit, to which the coil device 200 is applied, may be a device that directly drives a movable body, or a device that controls oil pressure to indirectly drive a movable body, as well as the device that drives the needle 15.

Additional advantages and modifications will readily occur to those skilled in the art. The invention in its broader terms is therefore not limited to the specific details, representative apparatus, and illustrative examples shown and described.

What is claimed is:

1. A terminal structure of a coil device, comprising:

a coil that includes a bobbin and a rectangular conductive wire having a flattened quadrangular shape in cross section, wherein the wire is covered with a dielectric film and wound around the bobbin; and a terminal that includes a fusing part, wherein:

an end portion of the wire, which extends out of the coil, has first and second flat surfaces that are opposed to each other, and the fusing part is electrically connected to the first and second flat surfaces by fusing;

the fusing part includes:

a planar portion that has a shape of a plate and is in surface contact with the first flat surface of the first and second flat surfaces; and a folded piece that extends from the planar portion and is folded in a direction perpendicular to a plane of the planar portion such that the end portion of the wire is clamped between the planar portion and the folded piece;

the folded piece includes a contact surface portion which is in contact with the second flat surface;

the contact surface portion includes a planar main part and a stepped portion that is shifted by a level difference Δt from the planar main part toward the second flat surface, wherein the planar main part and the stepped portion extend side by side in a longitudinal direction of the folding piece, which is perpendicular to a longitudinal direction of the end portion of the wire, wherein the planar main part and the stepped portion are arranged side by side in the longitudinal direction of the end portion of the wire, and wherein the planar main part and the stepped portion are shifted by the level difference Δt in a direction perpendicular to the longitudinal direction of the folding piece and perpendicular to the longitudinal direction of the end portion of the wire; and the stepped portion is in contact with the second flat surface to increase an amount of deformation of a contact area of the second flat surface which is in contact with the stepped portion, in comparison to an adjacent area of the second flat surface that is adjacent to the contact area.

2. The terminal structure according to claim 1, wherein the stepped portion includes a flat surface which is in surface contact with the second flat surface and which expands in a direction that is perpendicular to the longitudinal direction of the second flat surface.

3. The terminal structure according to claim 1, wherein the stepped portion includes a flat surface which is in surface contact with the second flat surface and which expands parallel to an axis of the folded piece in a folding direction of the folded piece.

4. The terminal structure according to claim 1, wherein the stepped portion is located at an end portion of the contact surface portion on a cut-off discardable side of the wire in the longitudinal direction of the end portion of the wire.

5. The terminal structure according to claim 1, wherein:

the stepped portion includes a bending surface which is in surface contact with the second flat surface; and the bending surface expands in a direction that is perpendicular to the longitudinal direction of the second flat surface, and has a cross-sectional shape that projects toward the second flat surface.

6. The terminal structure according to claim 1, wherein the stepped portion is located between an end portion of the contact surface portion on a cut-off discardable side of the wire and an end portion of the contact surface portion on an opposite side of the end portion in the longitudinal direction of the end portion of the wire.

7. The terminal structure according to claim 1, wherein:

the terminal further includes a conductive wire bundle portion between the coil and the fusing part;

an intermediate part of the wire, which is taken out from the coil, is wound and bundled around the bundle portion; and the bundle portion includes a turning guide portion that is formed to convert the longitudinal direction of the end portion of the wire, which is taken out from the coil, so as to guide the end portion of the wire to the fusing part.

* * * * *